United States Patent [19]

Bumgarner, Sr.

[11] Patent Number: 4,625,343

[45] Date of Patent: Dec. 2, 1986

[54] COPING ATTACHMENT SYSTEM

[76] Inventor: John C. Bumgarner, Sr., 414 S. Crain Hwy., Glen Burnie, Md. 21061

[21] Appl. No.: 785,254

[22] Filed: Oct. 7, 1985

[51] Int. Cl.[4] ..... E04B 1/16

[52] U.S. Cl. ..... 4/506; 52/300; 249/DIG. 3

[58] Field of Search ..... 4/506, 510–513; 52/169.7, 300; 249/DIG. 3, 91; 264/33, 34, 35

[56] References Cited

U.S. PATENT DOCUMENTS

| | | | |
|---|---|---|---|
| 2,873,505 | 2/1959 | Sheldon | 249/DIG. 3 |
| 3,239,975 | 3/1966 | Stier | 52/300 |
| 3,351,958 | 11/1967 | Shields | 52/300 |
| 3,444,659 | 5/1969 | Shanni | 52/300 |
| 3,511,002 | 5/1970 | Fox | 52/300 |
| 3,777,318 | 12/1973 | Stillman, Jr. | 52/300 |
| 3,785,099 | 1/1974 | Greene | 4/506 |
| 3,835,481 | 9/1974 | Engelhart et al. | 52/300 |
| 3,986,310 | 10/1976 | Van der Broek | 52/300 |
| 4,457,119 | 7/1984 | Dahowski | 52/300 |
| 4,574,017 | 3/1986 | Stegmeier | 249/DIG. 3 |

*Primary Examiner*—Stephen Marcus
*Assistant Examiner*—Leo J. Peters
*Attorney, Agent, or Firm*—John F. McClellan, Sr.

[57] ABSTRACT

A system for use in swimming pool construction for temporarily holding a rounded coping to a wall form during pouring of concrete, making the coping a permanent part of the swimming pool but permitting quick removal of the wall form, includes, at intervals, a lag screw rotatably mounted on the top of the wall form in position for the threaded pointed end of the lag screw to engage a vinyl liner slot in the coping, and when rotated to draw the coping against the wall form. To prevent the screw from "walking" in the slot when rotated and to assure coping level, an even coping line and straight wall construction, a coping alignment track on the wall form has a lateral protrusion fitted into the vinyl liner slot and length extending longitudinally of the coping from one lag screw to the next.

8 Claims, 4 Drawing Figures

COPING ATTACHMENT SYSTEM

FIELD OF THE INVENTION

This invention relates generally to coping systems and particularly to an improved system for coping attachment to wall form panels used in custom designed concrete-and-vinyl liner swimming pools.

BACKGROUND OF THE INVENTION

Prior U.S. patent shows that are known include the following:

U.S. Pat. No. 3,239,975 issued to K. L. Stier on 3-15-66 showed a composited "C"-shaped or rounded plastic and concrete coping arrangement and concrete deck;

U.S. Pat. No. 3,351,958 issued to E. H. Shields on 11-14-67 showed a number of plastic coping arrangements in cushioned construction;

U.S. Pat. No. 3,444,659 issued to V. Shanni on 5-20-69, showed a bolted-on "C"-shaped coping;

U.S. Pat. No. 3,511,002 issued to G. C. Fox, on 5-12-70, showed concrete-filled-rounded coping structure, and concrete deck;

U.S. Pat. No. 3,835,481 isssued to J. M. Englehart and William P. Morrish on 9-17-74, showed a two-piece coping arrangement with poured concrete fill;

U.S. Pat. No. 4,457,119 issued to D. E. Dahowski, showed another form of plastic coping held as a permanent assembly with concrete.

SUMMARY OF THE INVENTION

None of the known art provided a coping-to-form wall attachment system that could be installed at any point along a length of coping without preparation of attachment points on the coping, and to provide such a system is a principal object of this invention.

Further objects are to provide a system as described that employs only crude, cheap fasteners that can be installed quickly and removed quickly that can compensate for misalignment vertically, and that are substantially unbreakable and are re-usable.

Still further objects are to provide a system as described that employs only a few pieces that are relatively simple, and that requires minimum fabrication.

And yet further objects are to provide a system for use in swimming pool construction for temporarily holding a rounded coping to a wall form during pouring of concrete, making the coping a permanent part of the swimming pool but permitting quick removal of the wall form, includes, at intervals, a lag screw rotatably mounted on the top of the wall form in position for the threaded pointed end of the lag screw to engage a vinyl-liner slot in the coping, and when rotated to draw the coping against the wall form. To prevent the screw from "walking" in the slot when rotated and to assure coping level, an even coping line and straight wall construction, a coping alignment track on the wall form has a lateral protrusion fitted into the vinyl-liner slot and length extending longitudinally of the coping from one lag screw to the next.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
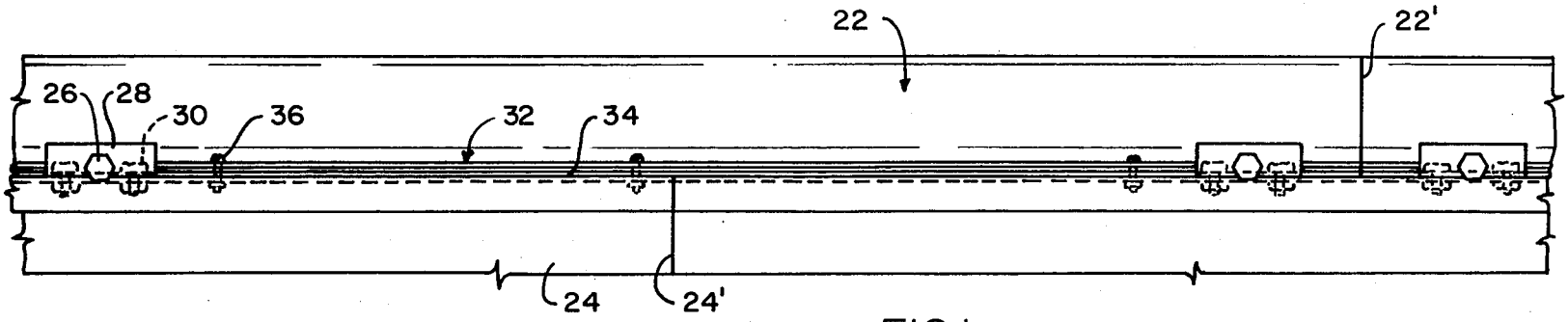
FIG. 1 is a side elevational view of a fragment of a coping held to a wall form by the system of this invention.

FIG. 1 is a layout detail showing relation of coping 22 to wall form 24, each in abutted lengths but with the respective joint 22', 24' preferably staggered.

A lag screw 26 mounted on a bracket 28 secured by bolts 30 connects the coping 22 and wall form 24.

A coping alignment track 32 secured to the top 34 of the wall form by bolts 36 assures that the coping is level, or parallel with the top 34 of the wall form, that the coping line is even, and that the resultant wall is straight.

Figure 2:
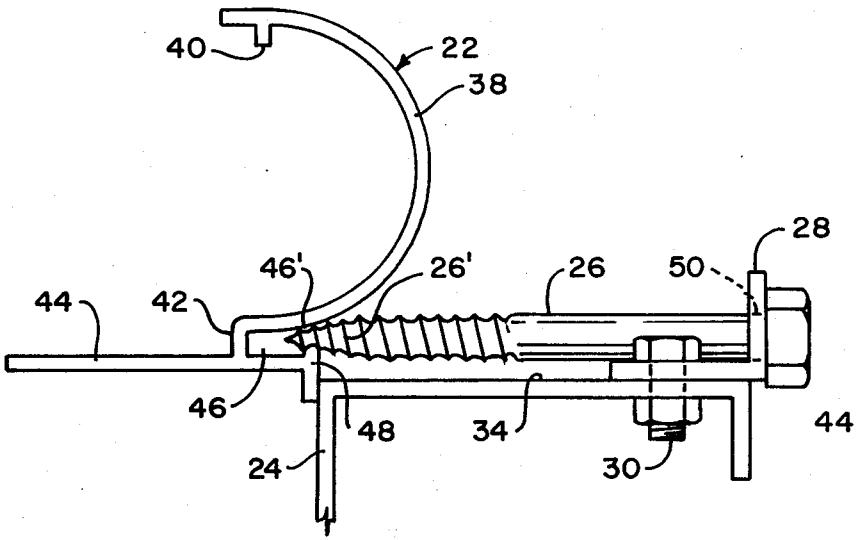
FIG. 2 is an end elevational view of a coping drawn to a wall form by a provision of this invention.

FIG. 2 shows that the coping 22 may be a known type with half-circle arc 38, inward flange 40 adjacent the upper end, downward connecting portion 42 joining the arc 38 to horizontal portion 44, and vinyl-liner retaining longitudinal recess 46.

The recess 46 is formed between the horizontal member 44 and the lower part of the arc 38. An upright lip 48 on the pool side of the horizontal portion 44 that constricts the opening 46' of the recess and projects downwardly to rest against the wall form 24 when drawn by lag screw 26, is shown.

Lag screw 26 extends horizontally. It may be turned freely by the head in mounting hole 50 in bracket 28, which is attached by the pair of bolts 30 to the top 34 of the wall form 24. Turning the lag screw 26 causes the tapered screw threads 26' at the pointed end to engage with and draw (or repel, depending on direction of rotation, lthe coping at constricted opening 46'.

Figure 3:
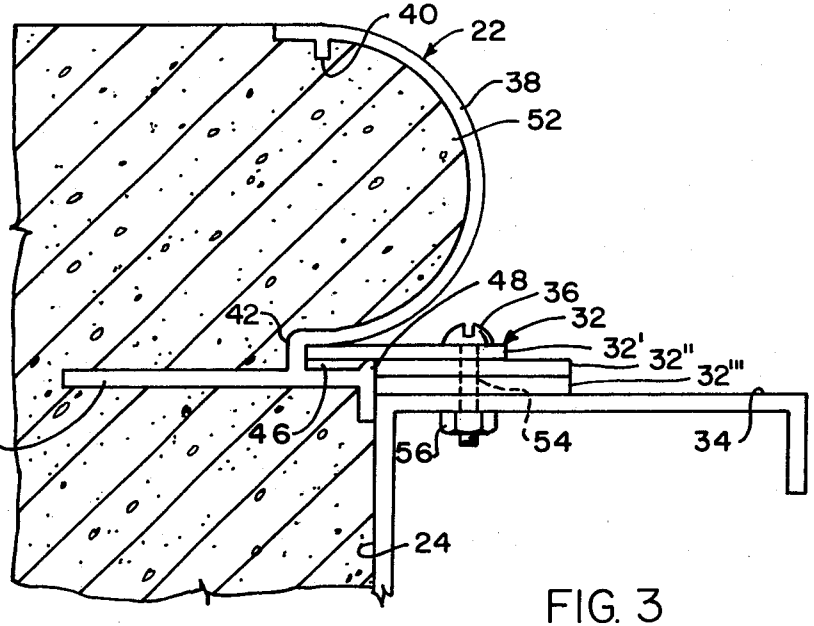
FIG. 3 is an end elevational view, with concrete parts in section, of a coping aligned with a wall form by a coping alignment track according to this invention.

FIG. 3 shows the coping 22 filled with poured concrete 52 that is tangent to the upper part and that is flush against the upright outer face of the wall form 24.

Coping alignment track 32 comprising at least one longitudinal plate structure, if of special-sectional form, and preferably of a plurality of plates 32', 32'', 32''' as shown, the lower two shimming up the upper plate, extends from lag screw to lag screw. Bolts 36 hold the plates to the top 34 of the wall form 24, passing through holes 54 and securing by a nut 56.

Top plate 32' projects into recess 46, bearing on the lower part of the arc 38 and on the upper part of the upright portion 48, of the coping 22.

Figure 4:
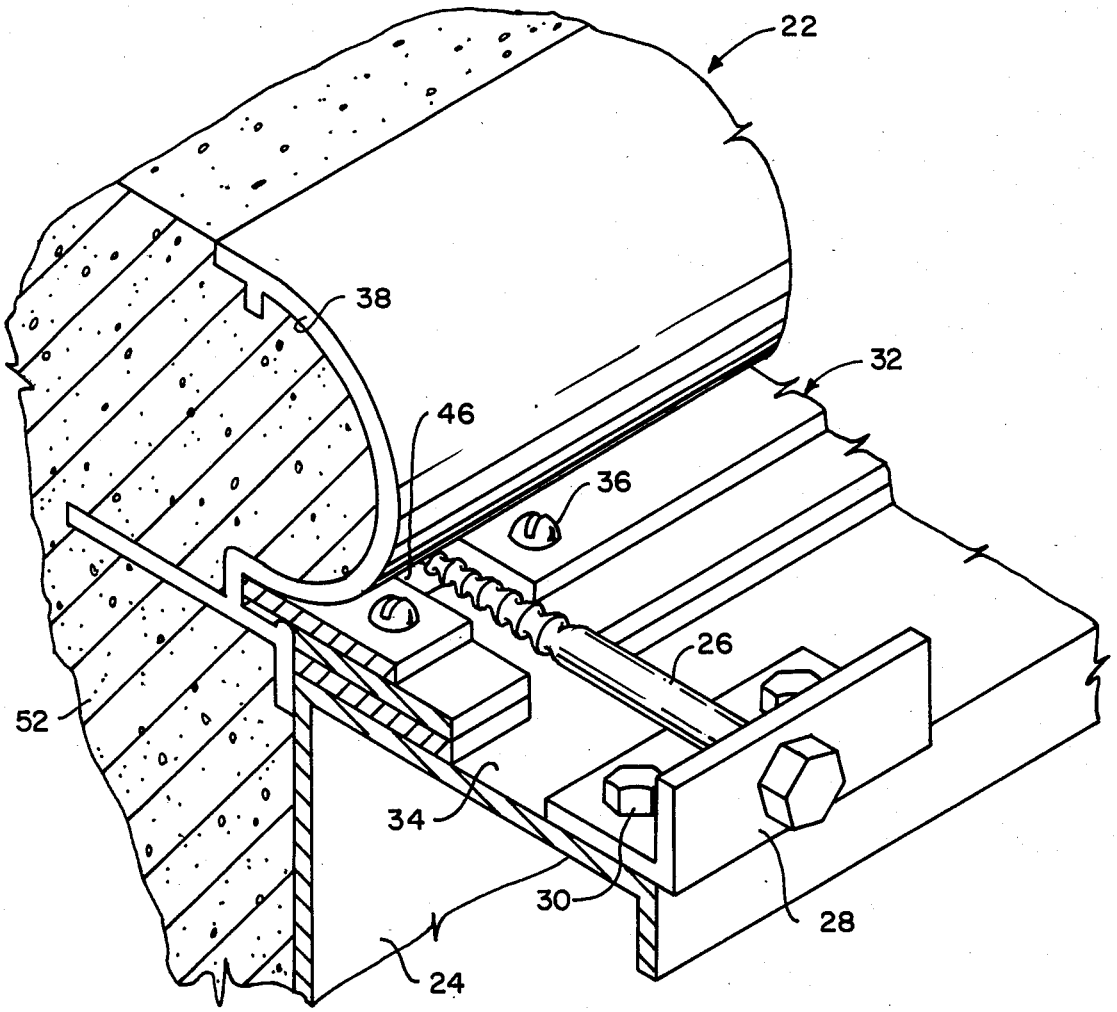
FIG. 4 is a perspective fragmentary detail.

FIG. 4 shows details of the assembly, slightly exaggerated for exposition. The coping alignment track at 32 would on both sides preferably fit closely adjacent the lag screw 26 as means for stabilizing the lag screw against walking when turned.

The coping may be standard anodized or coated aluminum. The wall forms may be of galvanized steel. The remaining parts may also be of galvanized steel.

The simplicity and economy and ease and speed of set-up and knock-down of the system will be appreciated.

What is claimed and desired to be protected by U.S. Letters Patent is:

1. In a system for use in forming a poured-concrete swimming pool having: an integral, rounded metal coping located for being held in place by said poured concrete as a permanent part of said swimming pool and with a vinyl-liner-retaining longitudinal recess opening laterallly therein and an upright lip forming a constriction in said opening by projecting upward towards said coping, and having a temporary upright wall form with a substantially horizontal top for detachable securance to said coping, the improvement comprising: means for detachably securing said coping to the temporary wall form including: a screw, means for rotatably mounting the screw to said top, and the screw having a tapering diameter thread engaging said constriction and drawing a portion of said coping against structure of the wall form when said screw is rotated.

2. A system as recited in claim 1, said portion of the coping comprising a lower part of said upright lip.

3. A system as recited in claim 2, said structure of the wall form comprising an upright part of the wall form and a coping alignment track in the form of at least one plate, and means for securing the at least one plate to said top with an edge portion thereof fitting into said coping at said constriction.

4. A system as recited in claim 3, and means for preventing said screw from moving along the coping when rotated, comprising a said plate on each side of the screw and having an end portion abutting said screw.

5. A system as recited in claim 3, the means for securing comprising a pair of said plates in position shimming up said at least one plate.

6. A system for use in forming a poured-concrete swimming pool having; an integral, rounded coping with a vinyl-liner-retaining longitudinal recess opening laterally therein and an upright lip forming a constriction in said opening by projecting upward towards the coping, and having an upright wall form with a substantially horizontal top for detachable securance to said coping, the improvement comprising: means for detachably securing said coping to the wall form including: a lag screw, means for rotatably mounting the lag screw to said top, the lag screw having a thread tapering on a substantially pointed end, engaging said constriction and drawing a portion of said coping against structure of the wall form when said lag screw is rotated, said portion of the coping comprising a lower part of said upright lip, said structure of the wall form comprising an upright part of the wall form and a coping alignment track in the form of at least one plate, and means for securing the at least one plate to said top with an edge portion thereof fitting into said coping at said constriction.

7. A system as recited in claim 6, and means for preventing said lag screw from moving along the coping when rotated, comprising a said plate on each side of the lag screw and having an end portion abutting said lag screw.

8. A system as recited in claim 6, the means for securing comprising a pair of said plates in position shimming up said at least one plate.

* * * * *